US011826806B2

(12) United States Patent
Aumayr

(10) Patent No.: US 11,826,806 B2
(45) Date of Patent: Nov. 28, 2023

(54) COIL MADE OF A COILED METAL STRIP HAVING A MARKING, AND USE OF SAID MARKING

(71) Applicant: Austria Metall GmbH, Braunau am Inn-Ranshofen (AT)

(72) Inventor: Werner Aumayr, Linz (AT)

(73) Assignee: Austria Metall GmbH, Braunau am Inn-Ranshofen (AT)

( * ) Notice: Subject to any disclaimer, the term of this patent is extended or adjusted under 35 U.S.C. 154(b) by 579 days.

(21) Appl. No.: 17/040,367

(22) PCT Filed: Mar. 22, 2019

(86) PCT No.: PCT/EP2019/057339
§ 371 (c)(1),
(2) Date: Sep. 22, 2020

(87) PCT Pub. No.: WO2019/180258
PCT Pub. Date: Sep. 26, 2019

(65) Prior Publication Data

US 2021/0053101 A1 Feb. 25, 2021

(30) Foreign Application Priority Data

Mar. 22, 2018 (EP) ..... 18163493
Feb. 12, 2019 (EP) ..... 19156796
Feb. 27, 2019 (EP) ..... 19159835

(51) Int. Cl.
*B21C 51/00* (2006.01)
*B21C 5/00* (2006.01)

(52) U.S. Cl.
CPC ..... *B21C 5/00* (2013.01)

(58) Field of Classification Search
CPC ..... B21C 51/00; G06K 19/00; G06K 19/04; G06K 19/06; G06K 19/0614
USPC ..... 235/487, 491, 493, 494, 495, 454
See application file for complete search history.

(56) References Cited

U.S. PATENT DOCUMENTS 6,187,455 B1 2/2001 Eschauzier
6,889,906 B1 * 5/2005 Matthewson .... G06K 19/06028 235/494
2020/0134839 A1 * 4/2020 Sevostianov ..... G06F 3/014

FOREIGN PATENT DOCUMENTS

WO 0113329 A1 2/2001

* cited by examiner

*Primary Examiner* — Edwyn Labaze

(57) ABSTRACT

A coil made of a coiled metal strip, in particular an aluminum strip, having a marking on a flat side of the metal strip. In order to be able, inter alia, to clearly identify the strip segments severed from the coil it is proposed that the marking, for allocating strip segments severed from the coil to the coil and the original position of the marking on the coil, comprises an information track, preferably extending across the entire strip length of the metal strip having a de-Bruijn sequence of successively arranged words of said de-Bruijn sequence or from a subset of the words of said de-Bruijn sequence.

24 Claims, 2 Drawing Sheets

COIL MADE OF A COILED METAL STRIP HAVING A MARKING, AND USE OF SAID MARKING

FIELD OF THE INVENTION

The invention relates to a coil of coiled metal strip, in particular an aluminum strip, having a marking on one flat side of the metal strip.

DESCRIPTION OF THE PRIOR ART

It is known from the prior art to mark the end of a coil of coiled or wound metal strip in order to give the coil a unique identification. Unfavorably such identification is lost on one flat side of the metal strip after the coil has been cut—for example, if the end of the coil is cut off. In addition, there is no marking whatsoever in all strip sections cut from the coil, for example sheet metal, slit strip, blanks, etc., except for the sheet metal section at the end. This makes it at least more difficult or even impossible to trace the strip sections. The position of the strip section on the original metal strip can also no longer be traced.

SUMMARY OF THE INVENTION

It is therefore the object of the invention to modify the marking of a coil in such a way that sections of the coil can be attributed both to the coil from which they were separated and to their original position on that coil. In addition, the marking should be easy to read and process visually.

If the marking has an information track provided over the, preferably entire, length of the metal strip, information from the metal strip can first be added to each strip section cut off from the metal strip, by means of which at least the coil from which the strip section was cut off can be traced. This makes it possible to assign strip sections that have been cut off from the coil to the coil.

If this information track also contains a de-Bruijn sequence of successive words from this de-Bruijn sequence, the respective markings on the separated strip sections can also be used to determine their original position in the metal strip. At least one word is located on each separated strip section as a sub-sequence of the de-Bruijn sequence, for example B(k,n) via an alphabet, preferably an alphanumeric alphabet, with a set of k characters and a length n of the words. On the basis of a part of the information track on the cut-off strip section, unambiguous information is thus available on the position on the metal strip of the coil or on the original coil in question. This makes it possible to assign strip sections that have been cut off from the coil to their original position on the coil.

Alternatively, this information track may also contain a de-Bruijn sequence from a subset of the words in this de-Bruijn sequence, which not only allows the former position of the strip section on the strip to be determined, but also makes it possible to distinguish from which coil the strip section in question originates. Each coil has a unique section of the de-Bruijn sequence via the partial sequence, which makes it possible to identify the coil from which the strip section originates via the section.

With known data on the information track on the strip, it is possible to draw conclusions about the position of this strip section on the strip, for example, by means of one or more words on the strip section.

Due to the invention, the tracing of all strip sections cut from the coil and thus also of the parts, components, etc. produced from them can be made possible. In addition, the information track is comparatively easy to read visually and easy to process, especially by machine.

The words in the de-Bruijn sequence can be formed from an alphabet with symbols that can be distinguished from one another. Such an alphabet can be made up of symbols, colors, characters, letters, numbers, Morse code, etc. or a combination of these.

For example, the information track may have a one- or two-dimensional de-Bruijn sequence. A one-dimensional de-Bruijn sequence also facilitates the processability of the information track, such as the readout and thus the provision of data.

Preferably, the de-Bruijn sequence can have the order k and words of length n. A de-Bruijn sequence of order 10 with words of length greater than or equal to 6 has proved to be particularly robust for marking a coil.

If the words in the de-Bruijn sequence are formed from an alphanumeric or numeric alphabet, this can further facilitate the processability—such as reading out and thus making data available—of the information track.

If the information track before and/or after each word of the de-Bruijn sequence has the respective same identification, in addition to information about the former position of the strip section on the strip, fixed information can also be provided on the strip section, e.g. information about the strip, the producer, customer, production date, etc. For example, one or more characters of the alphabet, preferably alphabetical, such as Latin letters, can be used for identification.

Preferably, the alphabet of the identification is different from the alphabet of the de-Bruijn sequence, so that the identification and the de-Bruijn sequence can be separated more easily. This can further facilitate the processability of the information track.

It is also the object of the invention to enable strip sections to be attributed both to the coil from which they were cut off and to their original position on that coil.

If a marking is used on a flat side of a metal strip wound into a coil, wherein the marking comprises an information track provided over the, preferably entire, strip length of the metal strip with a de-Bruijn sequence of successively arranged words of this de-Bruijn sequence or of a subset of the words of this de-Bruijn sequence, it may be possible to assign strip sections separated from the coil both to the coil and to their original position on the coil.

On each separated strip section there is at least one word once as a sub-sequence of the de-Bruijn sequence, for example B(k,n) via an alphabet, preferably alphanumeric, with a set of k characters and a length n of the words. On the basis of a part of the information track on the cut-off strip section, unambiguous information is thus available on the position on the metal strip of the coil or on the original coil in question. This makes it possible to assign sections of the strip that have been cut off from the coil to their original position on the coil.

Due to the invention, the tracing of all strip sections separated from the coil and thus also of the parts, components, etc. made from them can be made possible. In addition, the information track is comparatively easy to read visually and easy to process, especially by machine.

For example, the information track may have a one- or two-dimensional de-Bruijn sequence. A one-dimensional de-Bruijn sequence also facilitates the processability of the information track, such as the readout and thus the provision of data. The handling of the information track used can thus be facilitated.

Preferably, the de-Bruijn sequence can have the order k and words of length n when used. A de-Bruijn sequence of order 10 with words of length greater than or equal to 6 has proved to be particularly robust for marking a coil.

A sufficiently long de-Bruijn sequence can be ensured if the words in the de-Bruijn sequence are formed from an alphanumeric or numeric alphabet. In addition, this can further facilitate the use—such as reading out and thus making data available—of the information track.

Information about the strip, the producer, the customer, the date of production, etc., can be added to the marking in a reliable manner if the information track before and/or after each word of the de-Bruijn sequence has the same identification, for example consisting of one or more characters of the, preferably alphabetical, alphabet.

Preferably, the alphabet of the identification is different from the alphabet of the de-Bruijn sequence in order to distinguish more easily between the identification and the de-Bruijn sequence. This can further facilitate the processability of the information track.

If a hash value is formed over the information track of the coil, it can be used to check the authenticity and/or integrity of data and/or a document that is related to the coil or to strip sections separated from the coil. Data and/or a document provided with this hash value, e.g.: a delivery note, electronic documents, etc., can thus be uniquely assigned to a coil. Forgeries, manipulation, etc. are thus easily recognized.

BRIEF DESCRIPTION OF THE DRAWINGS

In the figures, for example, the subject matter of the invention is described in more detail by means of several embodiment variants.

DETAILED DESCRIPTION OF THE PREFERRED EMBODIMENTS

Figure 1:
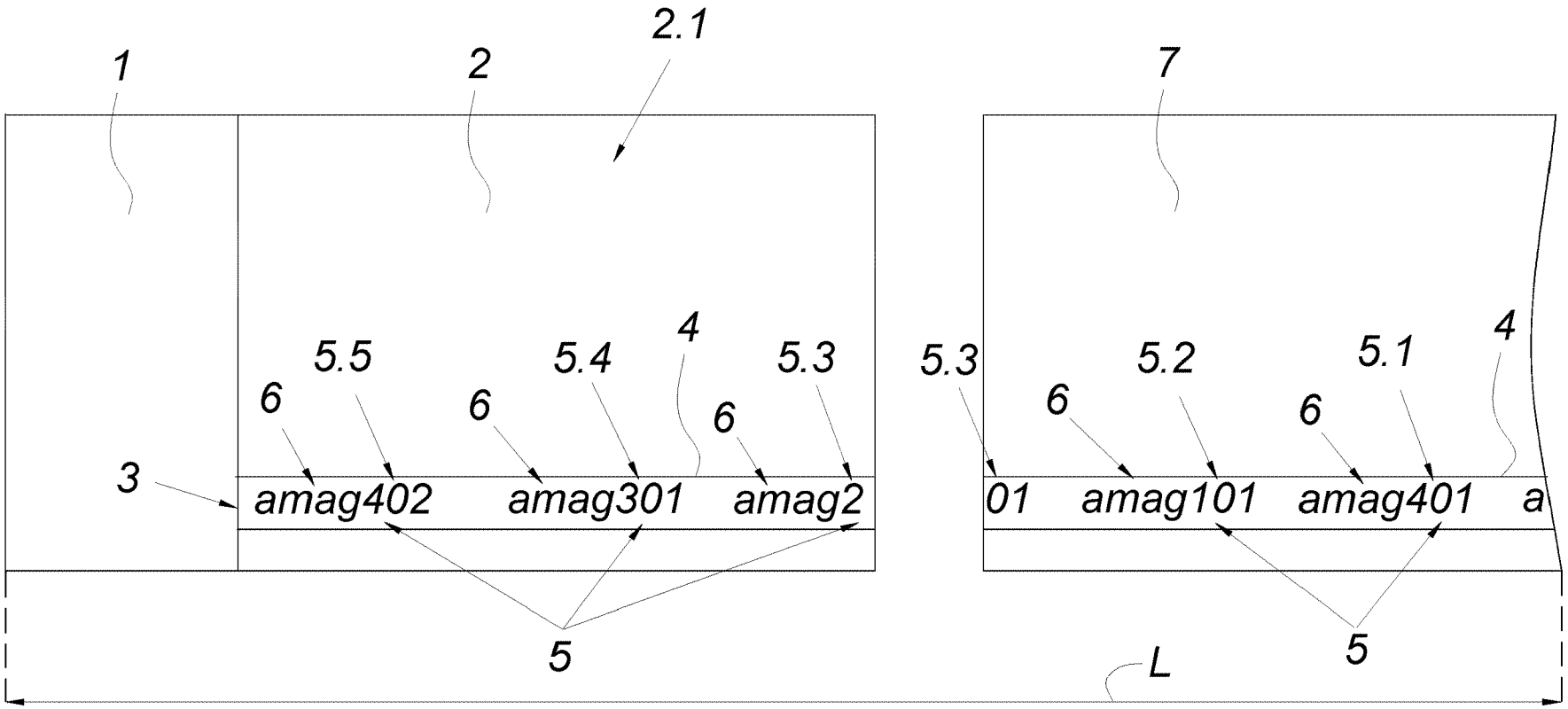
FIG. 1 shows a top view of a metal strip unwound from a coil according to a first embodiment example.

According to FIG. 1, for example, a metal strip 2 wound into a coil 1 or coil, namely aluminum strip, is shown according to a first embodiment example, which has a marking 3 for preferably unambiguous identification of coil 1 on a flat side 2.1. The marking 3 is printed on the metal strip 2. However, this marking 3 can also be provided on a label attached to metal strip 2, which is not shown in detail.

Figure 2:
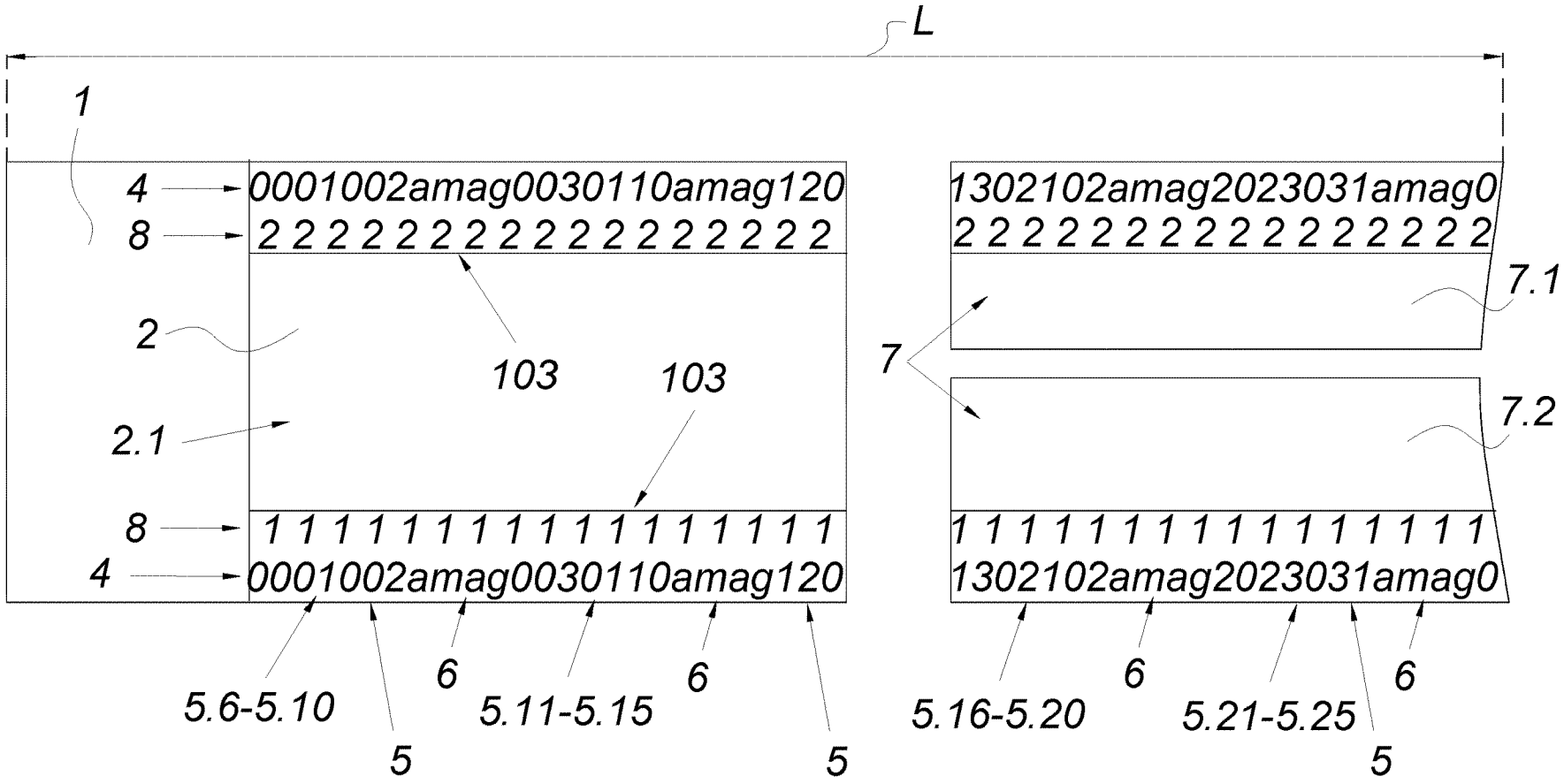
FIG. 2 shows a top view of a metal strip unwound from a coil according to a second embodiment example.

According to the invention, this printed marking 3 has an information track 4. This information track 4 is provided over the entire length L of the metal strip 2—preferably in the area of the longitudinal edge of the metal strip 2. In addition, this information track 4 has words 5.1, 5.2, 5.3, 5.4, 5.5 of a de-Bruijn sequence 5 arranged in succession. These words 5.1, 5.2, 5.3, 5.4, 5.5 are shown spaced apart by spaces in FIG. 1 for better illustration—however, it is quite conceivable that the marking 3 is formed without spaces—as shown in FIG. 2 at marking 103.

For example, this is a de-Bruijn sequence B(5,3) above the, preferably numerical, alphabet {0, 1, 2, 3, 4} of especially natural numbers. The words 5.1, 5.2, 5.3, 5.4, 5.5 thus have the length n, namely 3—and the de-Bruijn sequence B(k,n) has the order k, namely 5. Of this de-Bruijn sequence B(5,3), the words {402}, {301}, {201}, {101} and {401} are recognizable in FIG. 1. This means that each word 5.1, 5.2, 5.3, 5.4, 5.5 of the de-Bruijn sequence occurs only once in information track 4 on metal strip 2.

Furthermore, information track 4 has the same identification 6, namely 'amag', before each word 5.1, 5.2, 5.3, 5.4, 5.5 of the de-Bruijn sequence B(5, 3), which identifies the producer. It is also conceivable to provide for the coil number, manufacturer code, etc. in information track 4 via identification 6. For this same identification 6, several characters of the alphabetical alphabet, for example from Latin letters, are used.

The numerical alphabet of the words in the de-Bruijn sequence and the alphabetical alphabet of the identification 6 make marking 3 easy to read visually and therefore readily processable.

According to the invention, it is thus possible, even after a strip section 7 has been separated from metal strip 2, to use the information track 4 remaining on strip section 7 to trace back not only the original coil with the marking "amag", but also the word 5.1, namely {401}, and/or the word 5.2, namely {101}, to the original position of strip section 7 on metal strip 2 of coil 1. Information track 4 is also comparatively easy to recognize visually and its information can thus be easily processed.

This is carried out with a handling-friendly, simple comparison of the known position of the information track on coil 1. A cut-through marking 3, as it can be recognized by the word 5.3, namely {201}, in FIG. 1, does not endanger the tracing of the strip section 7 according to the invention.

As can also be seen in FIG. 1, information track 4 contains a subset of all the words in the de-Bruijn sequence B(5, 3). This means that a de-Bruijn sequence B(5, 3) can be used to mark several strips with a unique identification of the strip sections 7 separated from them.

In contrast to FIG. 1, the marking 103 on coil 1 according to FIG. 2 in the second embodiment example is provided on the flat side 2.1 along opposite long sides 2.2, 2.3. This means that marking 103 can also remain on a strip section 7 which has been split into two slit strips 7.1, 7.2. In addition, marking 103 has a side numbering 8—namely 1 or 2—so that it is possible to recognize on slit strip 7.1, 7.2 which side the split strip section 7 is on.

An identification 6, namely "amag", is found in information track 4, which is marked in the same way as in FIG. 1 in the de-Bruijn sequence B(5,3) between two words 5.6-5.24 of the de-Bruijn sequence B(5,3). However, as illustrated, identification 6 is provided after 5 words 5.6-5.10, 5.11-5.15, 5.16-5.20 and 5.21-5.25 of the de-Bruijn sequence B(5,3). The words 5.6-5.10, namely {000}, {001}, {010}, {100}, {002}, the words 5.11-5.15, namely {003}, {030}, {301}, {011}, {110}, the words 5.16-5.20, namely {130}, {302}, {021}, {210}, {102}, and the words 5.21-5.25, namely {202}, {023}, {230}, {303}, {031}, are also sequentially arranged. Between the words 5.10 and 5.11 there are also the words {020}, {200}, between the words 5.15 and 5.16 there are also the words {101}, {013} and between the words 5.20 and 5.21 there are also the words {022}, {220} of the de-Bruijn sequence B(5,3), and at the free end of volume 2 there is the word {120} of the de-Bruijn sequence B(5,3).

A hash value is formed from information track 4 over the, preferably entire, information track 4 of the coil 1. For example, the hash value 5ce0c22a is formed from "0001002amag0030110amag120" of information track 4 using the hash function CRC32. This hash value 5ce0c22a creates a unique reference to information track 4. If data or a document is linked or provided with the hash value, the authenticity and/or integrity of this data or this document can be checked.

The invention claimed is:

1. A coil made of a coiled metal strip, comprising a marking on a flat side of the metal strip, wherein the marking is used for allocating strip segments separated from the coil to the coil and an original position of the marking on the coil, and the marking comprises an information track, extending across a strip length of the metal strip having a de-Bruijn sequence of successively arranged words of said de-Bruijn sequence or from a subset of the words of said de-Bruijn sequence.

2. The coil according to claim 1, wherein the information track has a one- or two-dimensional de-Bruijn sequence.

3. The coil according to claim 1, wherein the de-Bruijn sequence has an order k, and words of length n.

4. The coil according to claim 3, wherein k=10.

5. The coil according to claim 3, wherein n is greater than or equal to 6.

6. The coil according to claim 1, wherein the words of the de-Bruijn sequence are formed from an alphanumeric or numeric alphabet.

7. The coil according to claim 1, wherein the information track before and/or after each word or words of the de-Bruijn sequence has one identical identification each.

8. The coil according to claim 7, wherein the information track before and/or after each word or words of the de-Bruijn sequence has one identical identification each, from one or more characters of the alphabet.

9. The coil according to claim 8, wherein the alphabet of the identification differs from the alphabet of the de-Bruijn sequence.

10. The coil according to claim 8, wherein the information track before and/or after each word or words of the de-Bruijn sequence has one identical identification each, from one or more characters of the alphabet, in alphabetical order.

11. The coil according to claim 1, wherein the coiled metal strip is an aluminum strip.

12. The coil according to claim 1, wherein the information track extends across an entire strip length of the metal strip.

13. A method of using a marking on a flat side of a metal strip wound into a coil, comprising using a marking that comprises an information track provided over a strip length of the metal strip and having a de-Bruijn sequence of successively arranged words of said de-Bruijn sequence or of a subset of the words of said de-Bruijn sequence, for assigning strip segments separated from the coil both to the coil and to an original position of the strip segments on the coil.

14. The method according to claim 13, wherein the information track has a one- or two-dimensional de-Bruijn sequence.

15. The method according to claim 13, wherein the de-Bruijn sequence has an order k, and words of length n.

16. The method according to claim 15, wherein k=10.

17. The method according to claim 15, wherein n is greater than or equal to 6.

18. The method according to claim 13, wherein the words of the de-Bruijn sequence are formed from an alphanumeric or numeric alphabet.

19. The method according to claim 13, wherein the information track has, before and/or after each word or words of the de-Bruijn sequence, one identical identification each.

20. The method according to claim 19, wherein the information track has, before and/or after each word or words of the de-Bruijn sequence, one identical identification each, from one or more characters of the alphabet.

21. The method according to claim 20, wherein the alphabet of the identification differs from the alphabet of the de-Bruijn sequence.

22. The method according to claim 20, wherein the information track has, before and/or after each word or words of the de-Bruijn sequence, one identical identification each, from one or more characters of the alphabet, in alphabetical order.

23. The method according to claim 13, wherein a hash value is formed and used over the information track of the coil to check authenticity and/or integrity of data and/or a document related to the coil or related to strip segments separated therefrom.

24. The method according to claim 13, wherein the information track is provided over an entire strip length of the metal strip.

* * * * *